US009795866B2

(12) United States Patent
Belcher et al.

(10) Patent No.: US 9,795,866 B2
(45) Date of Patent: Oct. 24, 2017

(54) SYSTEMS AND METHODS FOR DYNAMIC BLOCKS FORMING A PASSAGEWAY

(71) Applicants: Jeb Belcher, Williamson, TX (US); Earl Wilson Belcher, Austin, TX (US)

(72) Inventors: Jeb Belcher, Williamson, TX (US); Earl Wilson Belcher, Austin, TX (US)

( * ) Notice: Subject to any disclaimer, the term of this patent is extended or adjusted under 35 U.S.C. 154(b) by 0 days.

(21) Appl. No.: 15/451,458

(22) Filed: Mar. 7, 2017

(65) Prior Publication Data

US 2017/0197138 A1 Jul. 13, 2017

Related U.S. Application Data

(63) Continuation-in-part of application No. 29/544,596, filed on Nov. 4, 2015, now Pat. No. Des. 784,458.

(51) Int. Cl.
*A63F 3/00* (2006.01)

(52) U.S. Cl.
CPC ..... *A63F 3/00097* (2013.01); *A63F 3/00214* (2013.01); *A63F 3/00261* (2013.01); *A63F 2003/00359* (2013.01)

(58) Field of Classification Search
USPC ..... 273/275, 241; 446/118
See application file for complete search history.

(56) References Cited

U.S. PATENT DOCUMENTS

2006/0043674 A1* 3/2006 Van Ness ..... A63F 3/00097 273/241

* cited by examiner

*Primary Examiner* — Vishu Mendiratta
(74) *Attorney, Agent, or Firm* — Pierson IP, PLLC

(57) ABSTRACT

Embodiments disclosed herein describe systems and methods for games with individual and independent pieces that are configured to move to create new routes and boards. Embodiments may include a series of symmetrical or asymmetrical blocks that can be dynamically moved or repositioned to for a maze with shifting channels or patterns.

15 Claims, 16 Drawing Sheets

SYSTEMS AND METHODS FOR DYNAMIC BLOCKS FORMING A PASSAGEWAY

CROSS-REFERENCE TO RELATED APPLICATIONS

This application is a continuation in part of U.S. Ser. No. 29/544,596 filed on Nov. 4, 2015, which is fully incorporated herein by reference in its entirety.

BACKGROUND INFORMATION

Field of the Disclosure

Examples of the present disclosure relate to blocks that are configured to be moved to form a passageway through a board. More specifically, embodiments are directed towards blocks with channels, wherein based on the positioning and geometrical features of the blocks the passageway through the board may change.

Background

A board game is a tabletop game that involves counters or pieces moved or placed on a pre-determined surface or board, according to a set of rules. The board game may allow users to move based on chance, strategy, skill, or a combination of different objectives.

Board games typically have a goal that a player aims to achieve. For example, a board game may be won by a player moving their piece from a first end of a static route to a second end of the static route. Alternatively, a board game may be won by a player strategically moving a plurality of pieces across a static board to obtain an objective, like chess.

However, conventional board games utilize static routes and static boards. Due to the static routes and boards, conventional board games can quickly become repetitive and/or boring.

Accordingly, needs exist for more effective and efficient systems and methods for games with individual and independent pieces that are configured to move to create new passageways and boards.

SUMMARY

Embodiments disclosed herein describe systems and methods individual and independent blocks that are configured to move to create new passageways through a board. The passageways may be utilized in various implementations to allow game pieces, liquids, or other objects to move through the passageways. Embodiments may include a series of symmetrical or asymmetrical blocks that can be dynamically and independently moved or rotated to form a maze with shifting channels or patterns.

Embodiments may include a shifting passageway or maze (referred to hereinafter individually and collectively as "passageway") formed of channels via configurable three dimensional blocks (referred to hereinafter "blocks"). The passageway may be created in the real world and/or a virtual world. The blocks may be independent removed from the system, repositioned, reoriented, etc. to create new channels to achieve different objectives.

Embodiments may utilize blocks with the same and/or different intentions, grooves, projections, protrusions, to form channels on an upper surface of the block. The channels may be utilized to form or close off a dynamic and changing passageway. This may be utilized to create a constantly changing board game and/or piece of art.

The blocks may be comprised of multiple colors, and different materials, such as wood, glass, plastic, etc.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
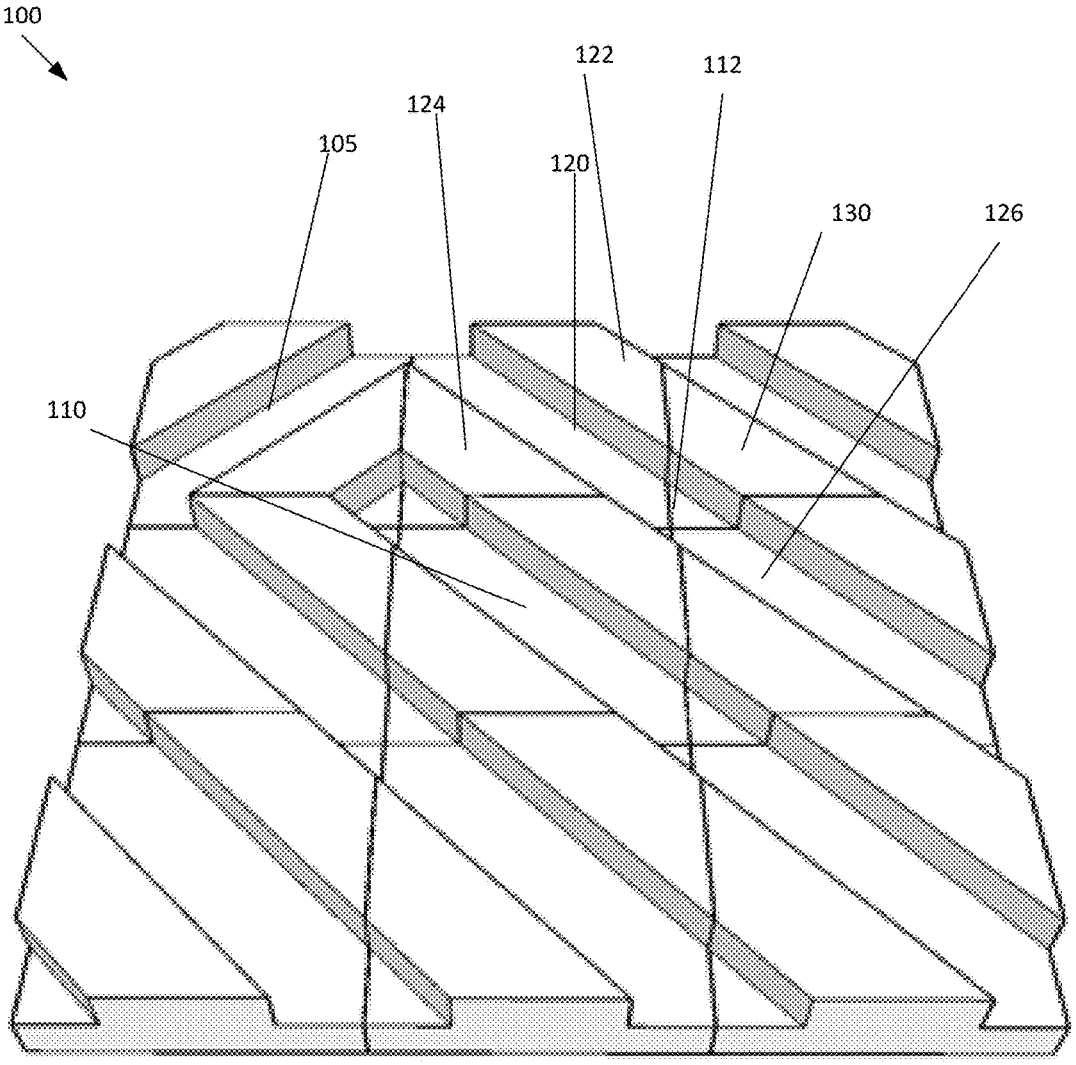
FIG. 1 depicts a board system comprised of independent and movable blocks, wherein a passageway may be formed by moving or repositioning blocks, according to an embodiment

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Turning now to FIG. 1, FIG. 1 depicts a board system 100 comprised of independent and movable blocks 110, wherein a passageway 105 through system 100 may be formed by moving or repositioning blocks 110, according to an embodiment. In embodiments, based on the geometry of movable blocks 110, board system 100 may always have a continuous passageway 105, which always includes a start point and an endpoint.

Embodiments of board system 100 may be utilized in combination with rules to create a game, be used as a system to create evolving artwork, or a network to transport objects through the passageway, such as an irrigation system. Embodiments of board system 100 may be recreated virtually, as part of a virtual world, or as real-world elements that can be physically touched. In the system 100 depicted in FIG. 1, nine blocks are arranged in a 3×3 square. However, one skilled in the art may appreciate that system 100 may be formed of any desired combination and number of blocks 110.

Movable blocks 110 may have planar edges, such that a second block 130 may be positioned adjacent to first block 110. Blocks 110, 130 may all have the same base shape, different base shapes, or a combination. For example, each block 110, 130 may have four edges forming squares, wherein the blocks 110, 130 are configured to be positioned adjacent to each other. In further implementations, blocks 110 may be dissected, divided, etc. into smaller parts forming the same geometrical shape as the original block. For example, blocks 110 may be cut in half or quarters to be formed of triangles. Blocks 110 may be configured to be removed from system 100, rotated, and reinserted into system 100, which may form a dynamic passageway 100 based on the layout of channel 120.

Channel 120 may be formed within a block 110 between projections 122, 124 extending across portions of block 110. Projections 122, 124 may extend upward away from a face surface of block to vertically offset an upper surface of projections 122, 124 from an upper surface of channel 120. Channel 120 may be positioned between the sidewalls associated with projections 122, 124. Furthermore, based on the respective positioning of first block 110 and second block 130, passageway 105 may seamlessly extend across both blocks 110, 130 via the channels 120, 126. Alternatively, a projection 122, 124 on second block 130 may end channel 120.

Figure 2:
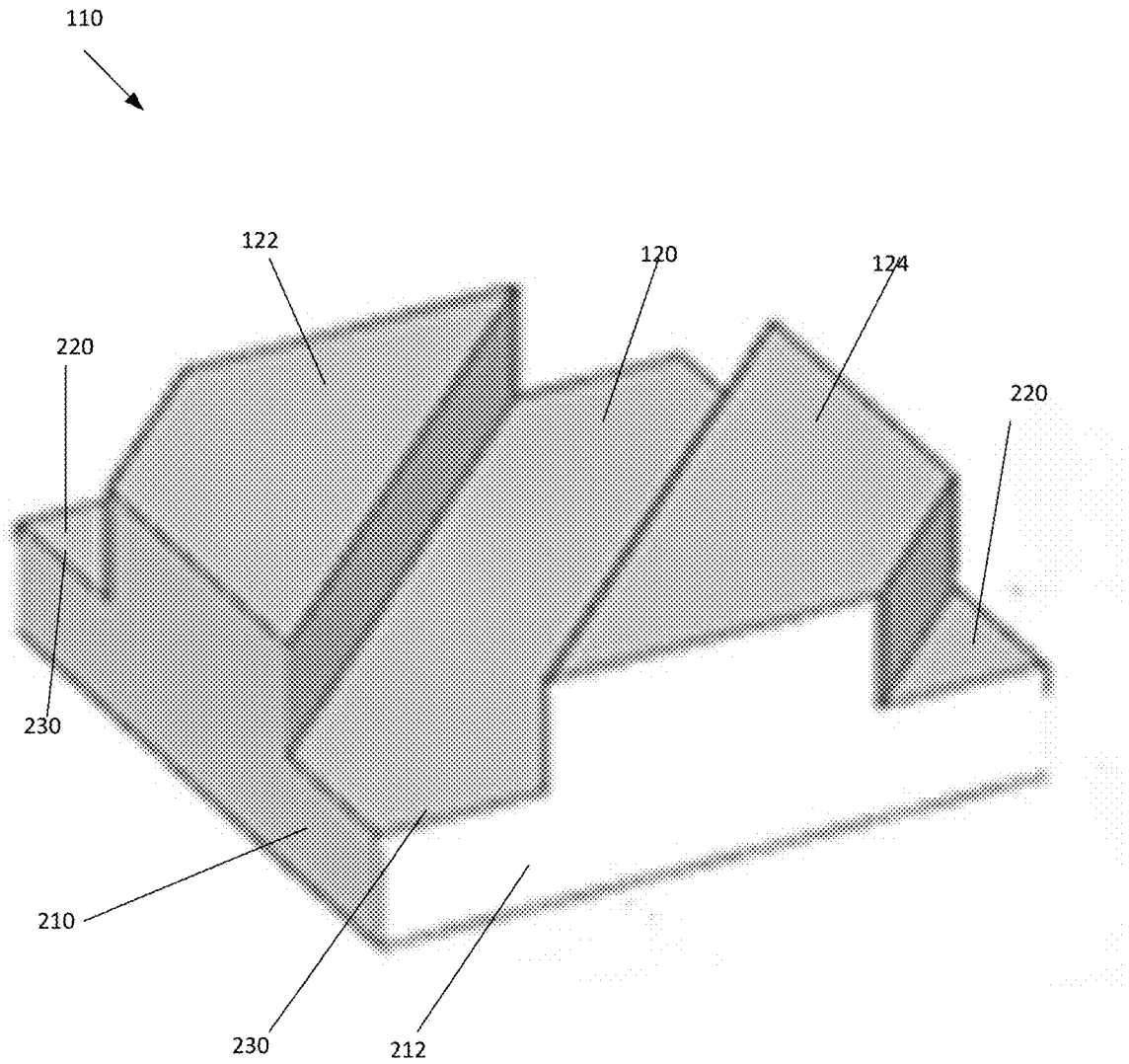
FIG. 2 depicts a perspective view of a block, according to an embodiment

FIG. 2 depicts a perspective view of block 110, according to an embodiment. Elements depicted in FIG. 2 may be described above. For the sake of brevity, a further description of these elements is omitted.

As depicted in FIG. 2, block 110 may include base 210, projections 122, 124, channel 120, and grooves 220.

Base 210 may be a lower structure of block 110. In embodiments, base 210 may include sidewalls 212 that are configured to extend upward from a level surface. The number of sidewalls 212 associated with base 210 may form a geometric shape of block 110. For example, as depicted in FIG. 2, base 210 may include four sidewalls, forming a square. However, one skilled in the art may appreciate that base 210 may have any number of sidewalls 212, and different blocks may have different numbers of sidewalls. As such, different blocks 110 may form different geometric shapes. The sidewalls 212 of base 210 may be planar such that a second block may be positioned flush against sidewall 212.

Projections 122, 124 may extend upward from an upward from an upper surface of base 210, such that an upper surface of projections 122, 124 is vertically offset from an upper surface of channel 120 and grooves 220. Projections 122, 124 may be any desired shape(s), which may be the same or different shapes. As such, projections 122, 124 may be the same shape, such as trapezoids, which may enable block 110 to be symmetrical. In embodiments, projections 122, 124 may have a first end that is positioned over a first sidewall 212 and a second end that is positioned over a second sidewall 212. However, other embodiments may include projections that have first and second ends positioned over the same sidewall.

Channel 120 may be positioned between projections 122, 124. Channel 120 may extend from one corner of block 110 to a second corner block 110. In embodiments, channel 120 may have a first end at a corner of block 110. Therefore, the first end of channel 120 may align with a second end of a channel positioned on a second block. As such, blocks may be repositioned to form new passageways extending across the system or board.

Grooves 220 may be positioned on an outer sidewall of projections 122, 124, and an upper surface of grooves 220 may have the same vertical offset as that of channel 120. As shown in FIG. 2, grooves 220 may be positioned on the corners of block 110. The positioning of grooves 220 may enable grooves positioning on a second and/or third block to form part of the passageway extending across the system or board. As such, a corner formed of four blocks may extend a passageway by utilizing the channel 120 of a first block 110, grooves of two adjacent blocks, and the channel of a block diagonally across from first block 110. Accordingly, the passageway(s) extending through system 100 may be directly affected, changed, blocked, extended, etc. based on the positioning of each of the surrounding blocks.

In embodiments, a length 230 between a corner of block 110 and projections 212, 214 may be the same for channel 120 and grooves 220. By having the length 230 between the corners of block 110 and projections 212, 214 being the same for channel 120 and grooves 220, channels and grooves of adjacent blocks may be arranged to line up with one another.

Figure 3:
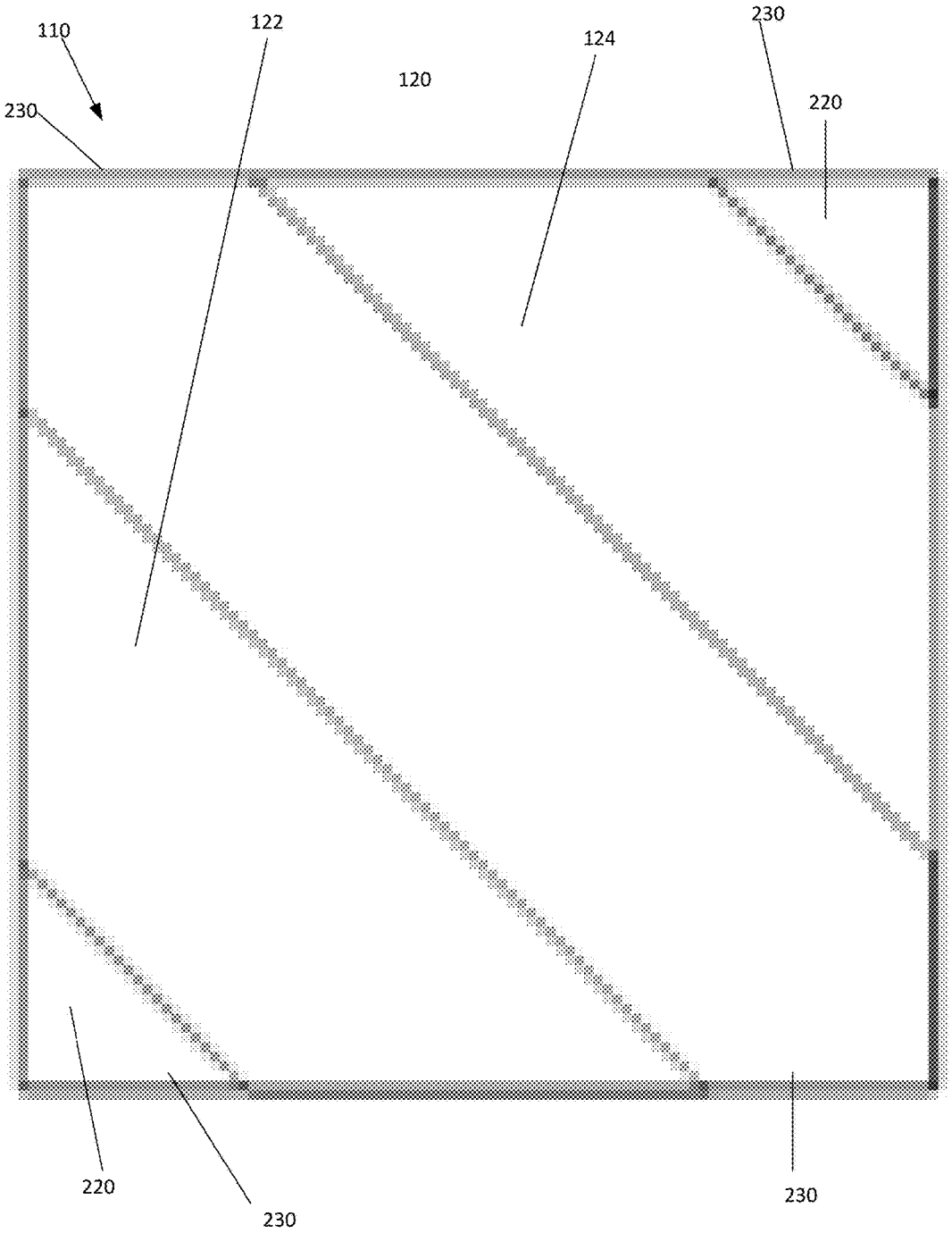
FIG. 3 depicts a top view of a block, according to an embodiment

FIG. 3 depicts a top view of block 110, according to an embodiment.

Elements depicted in FIG. 3 may be described above. For the sake of brevity, a further description of these elements is omitted.

As depicted in FIG. 3, channel 120 may extend diagonally across block 110 based on the layout of projections 122, 124. The remaining corners may be formed by grooves 220.

Figure 4:
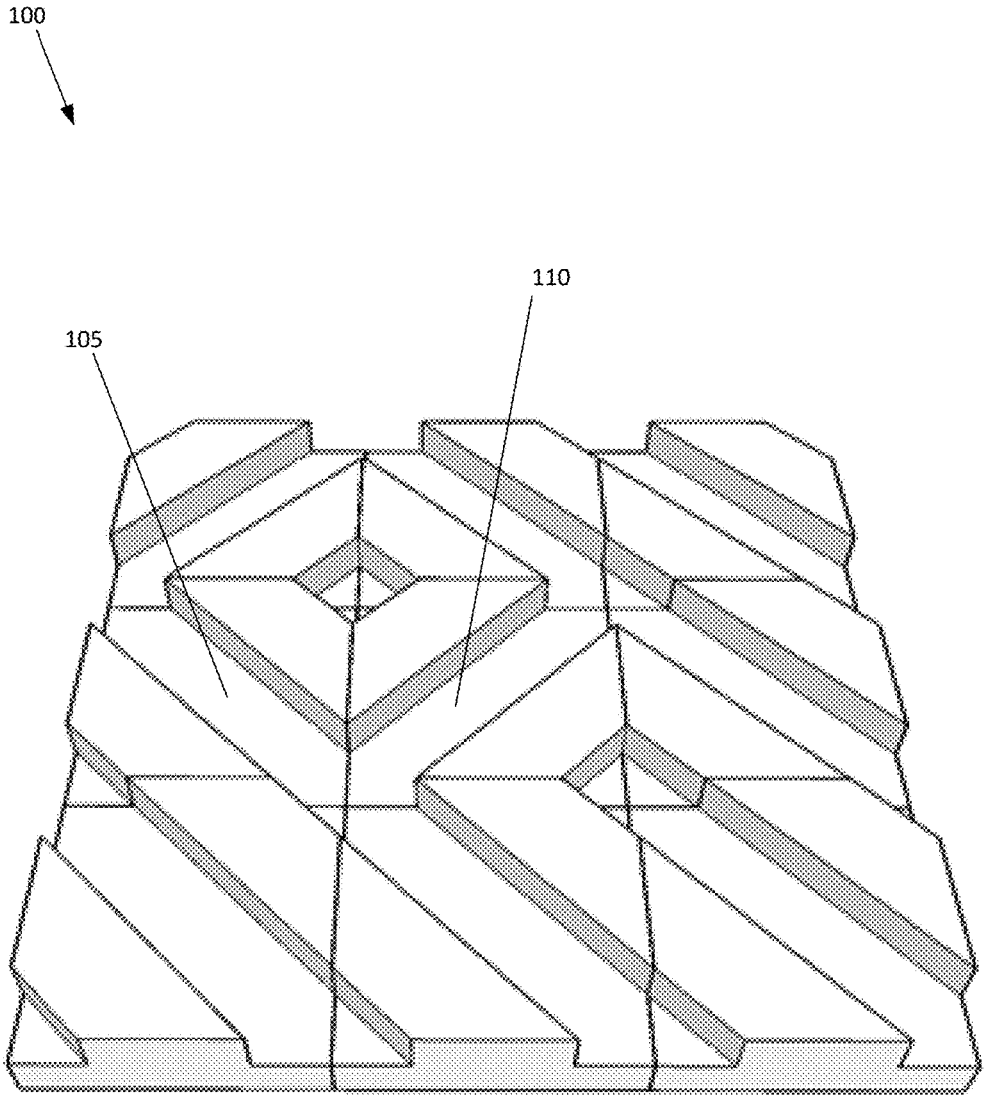
FIG. 4 depicts a system, according to an embodiment

FIG. 4 depicts a system 100, according to an embodiment. Elements depicted in FIG. 4 may be described above. For the sake of brevity, a further description of these elements is omitted. FIG. 4 may depict the same 3×3 layout of blocks 110 as depicted in FIG. 1. However. Block 110 may be rotated ninety degrees. Responsive to rotating block 110, passageway 105 may change to having a "U-Shaped" path to having an "H-Shaped" path. To this end, by rotating a single block 110 of system 100, a board or layout associated with system 100 may be dynamically changed. Further rotations in blocks 110 may lead to further changes of passageway 105, which could revert channel 120 to having a "U-Shaped" path.

In implementations, at the start of a first players turn or at the end of the players first turn, the first player may rotate block 110 (or any block on system 100) to change the layout of passageway 105. This may dynamically alter the board, playing field, objective, etc. of a game.

Figure 5:
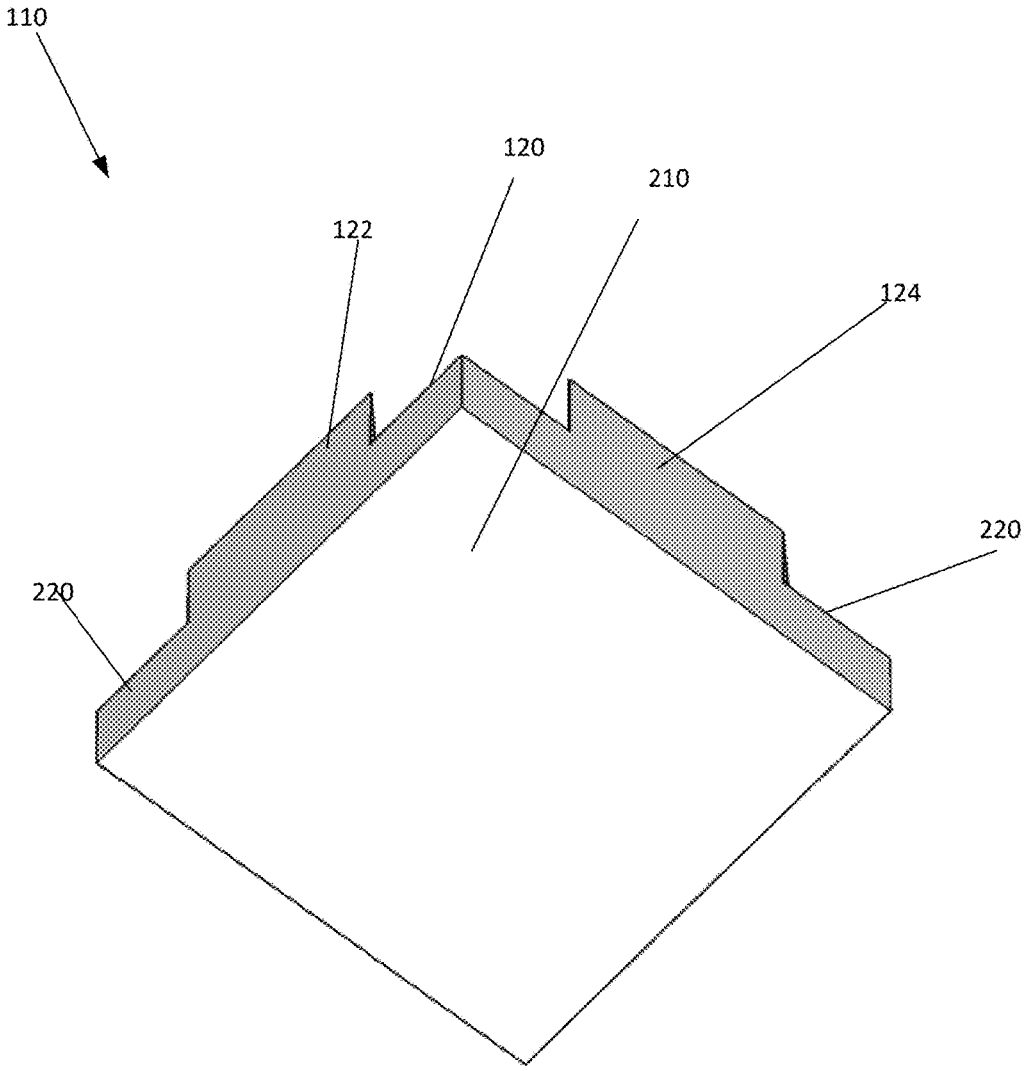
FIG. 5 depicts a bottom view of a block, according to an embodiment

FIG. 5 depicts a bottom view of block 110, according to an embodiment. Elements depicted in FIG. 5 may be described above. For the sake of brevity, a further description of these elements is omitted.

As depicted in FIG. 5, a bottom surface of base 210 may be planar and level. In further embodiments, the bottom surface of base 210 may include coupling mechanisms, such as pegs, magnets, buttons, etc. that are configured to enable the bottom surface to be coupled to another surface. In further embodiments, the bottom surface of base 210 may include springs, enabling base 210 to be lifted away from a planar surface, rotated, and repositioning in a new orientation.

Figure 6:
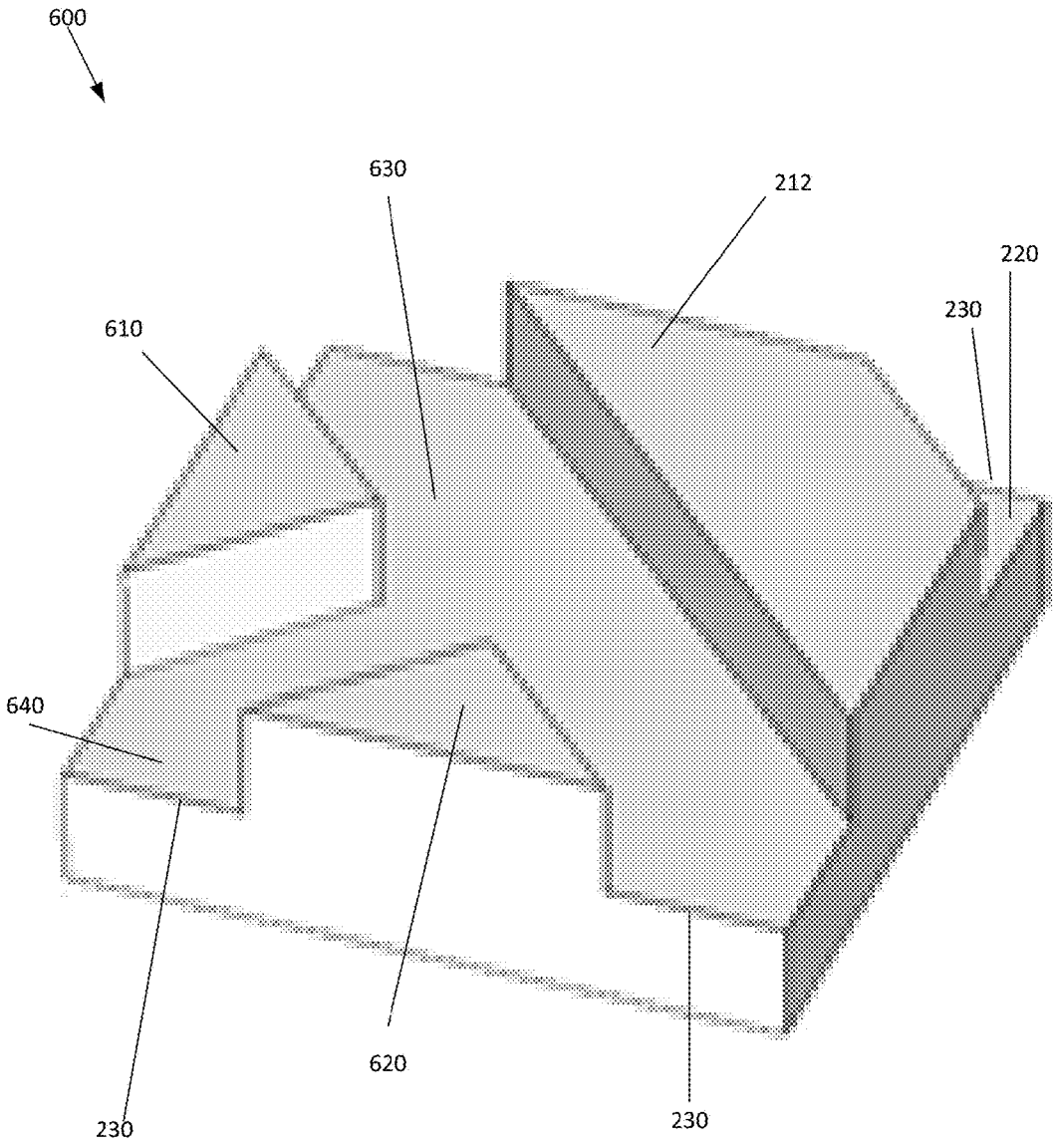
FIG. 6 depicts a perspective view of a block, according to an embodiment

FIG. 6 depicts a bottom view of block 600, according to an embodiment. Elements depicted in FIG. 6 may be described above. For the sake of brevity, a further description of these elements is omitted. In embodiments, system 100 may utilize blocks 110 and block 600 to create a dynamic channel, which may be used as the pathway for objects, pieces, liquids, etc. to travel on.

As depicted in FIG. 6, block 600 may be comprised of projection 212, which may be substantially similar to that in block 110. Such that a first bisection of block 600 is the same as that of block 110. However, a second bisection of block 600 may be different than that of block 110. Specifically, the second bisection of block 600 may include first projection 610 and second projections 620.

First projection 610 and second projection 620 may have upper surfaces with the same vertical offsets as projections on other blocks within system 100. Furthermore, between first projections 610, second projection 620, and projection 212, channels 630 and 640 may be formed. Channels 630, 640 may form a "T-Shaped" channel within block 600. This may be utilized to split or diverge the passageway(s) through system 100.

Channels 630 and 640 may have the same dimensions as channels in other blocks within system 100, such that channels 630 may be utilized to form a continuous passageway or blocked passageway within system 100. Furthermore, a length 230 between a corner of block 610 and projections 610, 620, 212 may be the same. Thus, channels 630 may be utilized to form the pathway through system 100.

Figure 7:
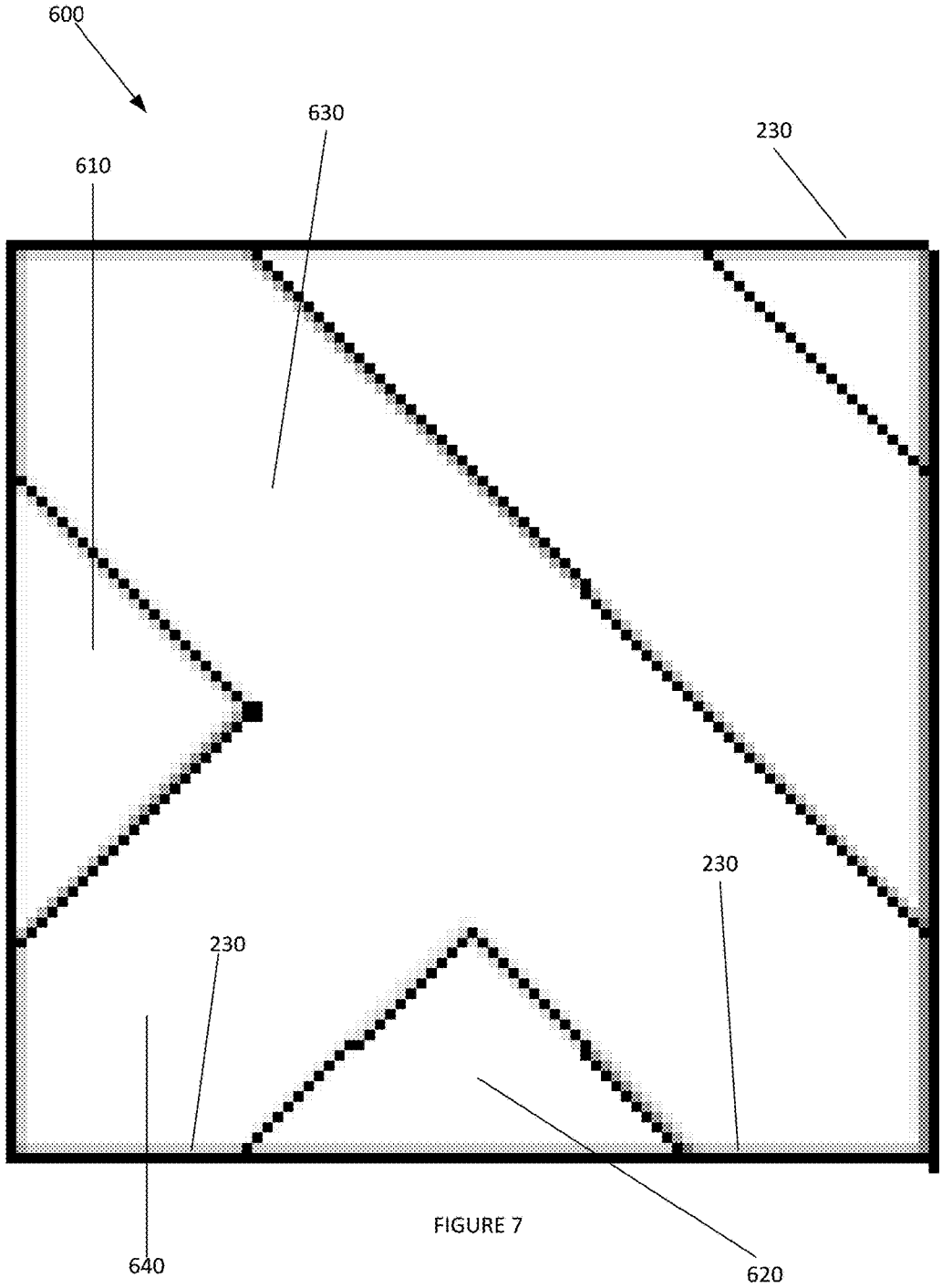
FIG. 7 depicts a top view of a block according to an embodiment.

FIG. 7 depicts a top view of block 700, according to an embodiment. Elements depicted in FIG. 7 may be described above. For the sake of brevity, a further description of these elements is omitted.

FIGS. 8-11 depict various layouts of system 100 utilizing blocks 110 and blocks 600, according to an embodiment.

As depicted in FIG. 8-11 a pathway within system 100 may be dynamically changed based on the channels associated with blocks 110 and 600. Furthermore, system 100 may incorporate blocks 110, 600 of different shapes with different projections and channels to form and change the pathway through the system 100.

Figure 8:
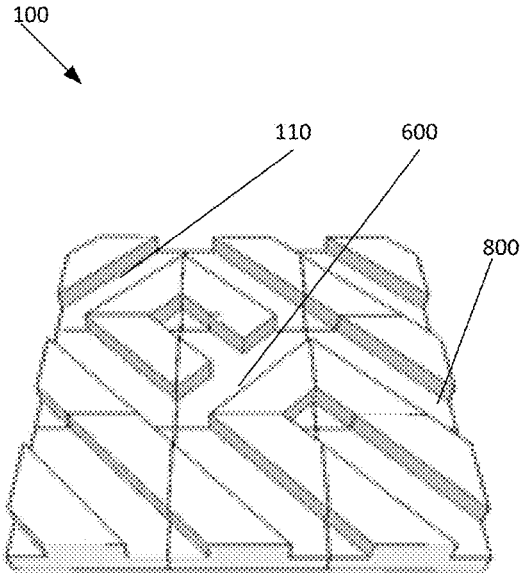
FIGS. 8-11 depict various layouts of a system utilizing blocks, according to an embodiment.
Figure 9:
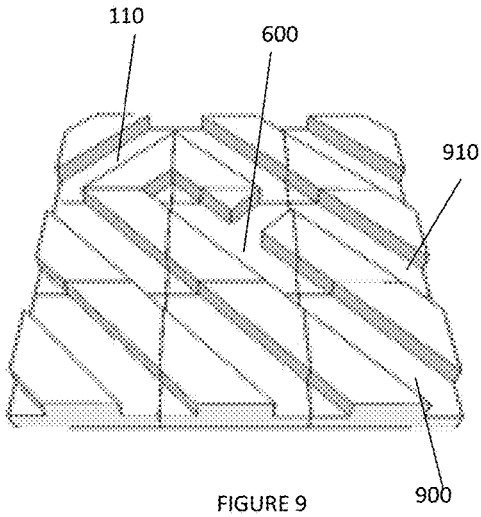

In FIG. 8, block 600 may be centrally located within system 100. In FIG. 9, block 600 may be rotated ninety degrees. This may cause a pathway through system 100 to diverge to have two ends 900, 910. The ends 900, 910 may have the same or different positioning as that of original end 800 in FIG. 8.

Figure 10:
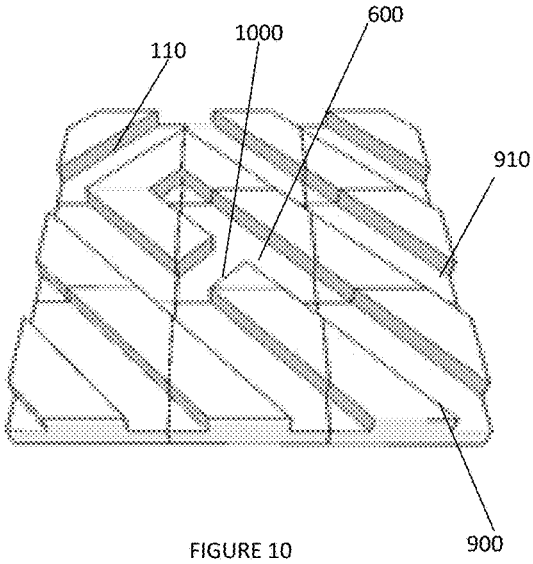

In FIG. 10, block 600 may be rotated one hundred eighty degrees. By rotating block 600 in FIG. 10, a channel 1000 within block 600 may change a divergent point of the pathway through system 100, such that one path to first end 900 is substantially shorter than that of second end 910.

Figure 11:
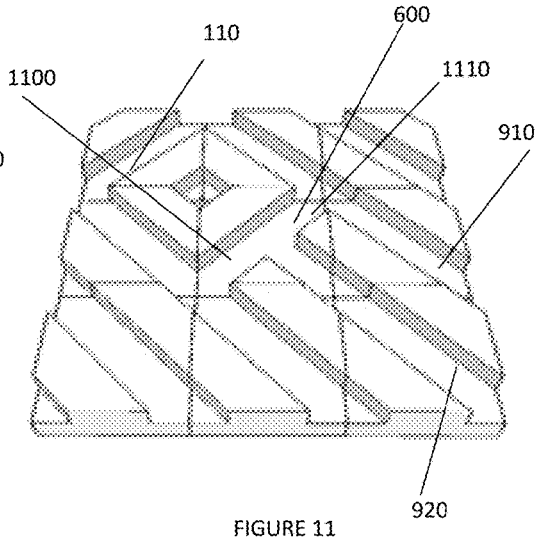

In FIG. 11, block 600 may be rotated two hundred seventy degrees. By rotating block 600 in FIG. 11, the pathway may have two positioned 1100, 1100 where the second end 900 of the pathway reconnects.

As such, by rotating a single block within system 100, the pathway throughout the entire system 100 may be dynamically changed. In embodiments, the blocks may be rotated by vertically raising the blocks away from system 100, and reinserting the rotated blocks within system 100. Furthermore, any desired number of blocks may be rotated.

As depicted in FIGS. 8-11, based on the geometries of each of the movable blocks 110 within board system 100, board system 100 may always include a continuous passageway. This may be due to each of the movable blocks 110 including grooves positioned on each of the corners of movable blocks 110. The positioning of the grooves on each of the corners of movable blocks 110 with different shaped projections on each of the movable blocks may enable different shaped paths based on the type of blocks, while always retaining at least one continuous path with star and endpoints.

Figure 12:
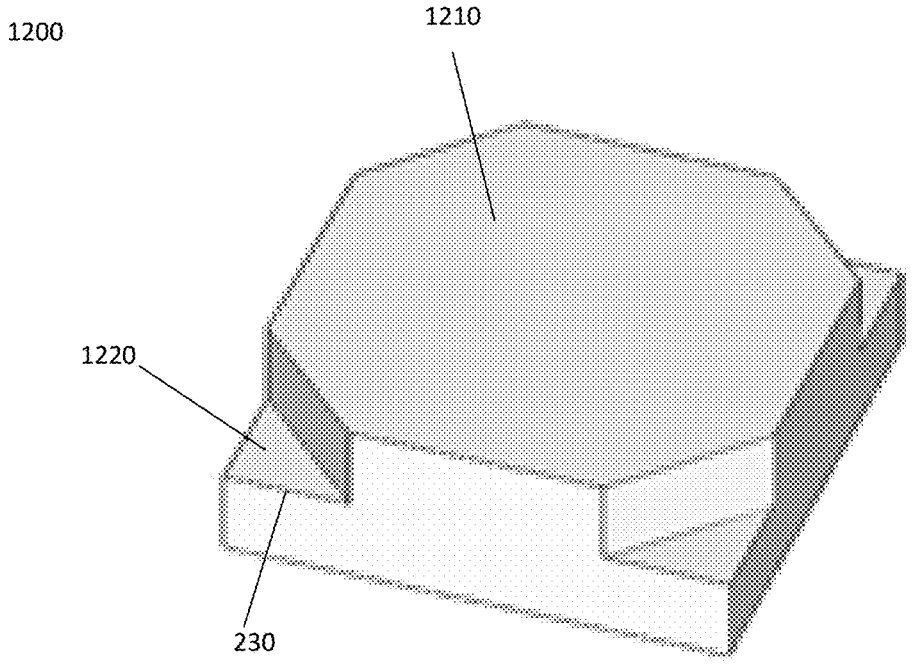
FIGS. 12 and 13 depict a perspective and bottom view of a block, according to an embodiment.
Figure 13:
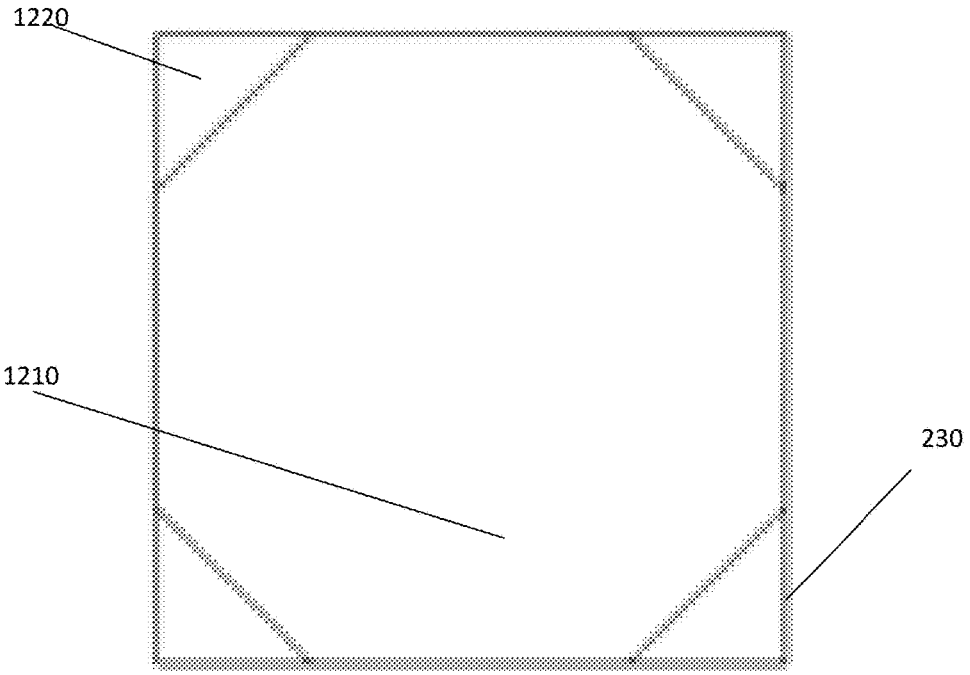

FIGS. 12 and 13 depict a perspective and top view of block 1200, according to an embodiment. Elements depicted in FIGS. 12 and 13 may be described above. For the sake of brevity, a further description of these elements is omitted.

As depicted in FIGS. 12 and 13, block 1200 may include a centrally located projection 1210, which is substantially octagonal in shape. Block 1200 may be utilized to limit, impede, etc. a passageway through system 100. Furthermore, the grooves 1220 positioned on the corners of block 1200 may be utilized to extend a channel of the passageway of adjacent blocks. A distance 230 from the corner of the block to a sidewall of projection 1220, may be the same distance 230 as other blocks. As such, block 1200 may be utilized to extend the passageway without creating additional channels in any direction. Furthermore, block 1200 may create the same effect on all adjacent channels.

Figure 14:
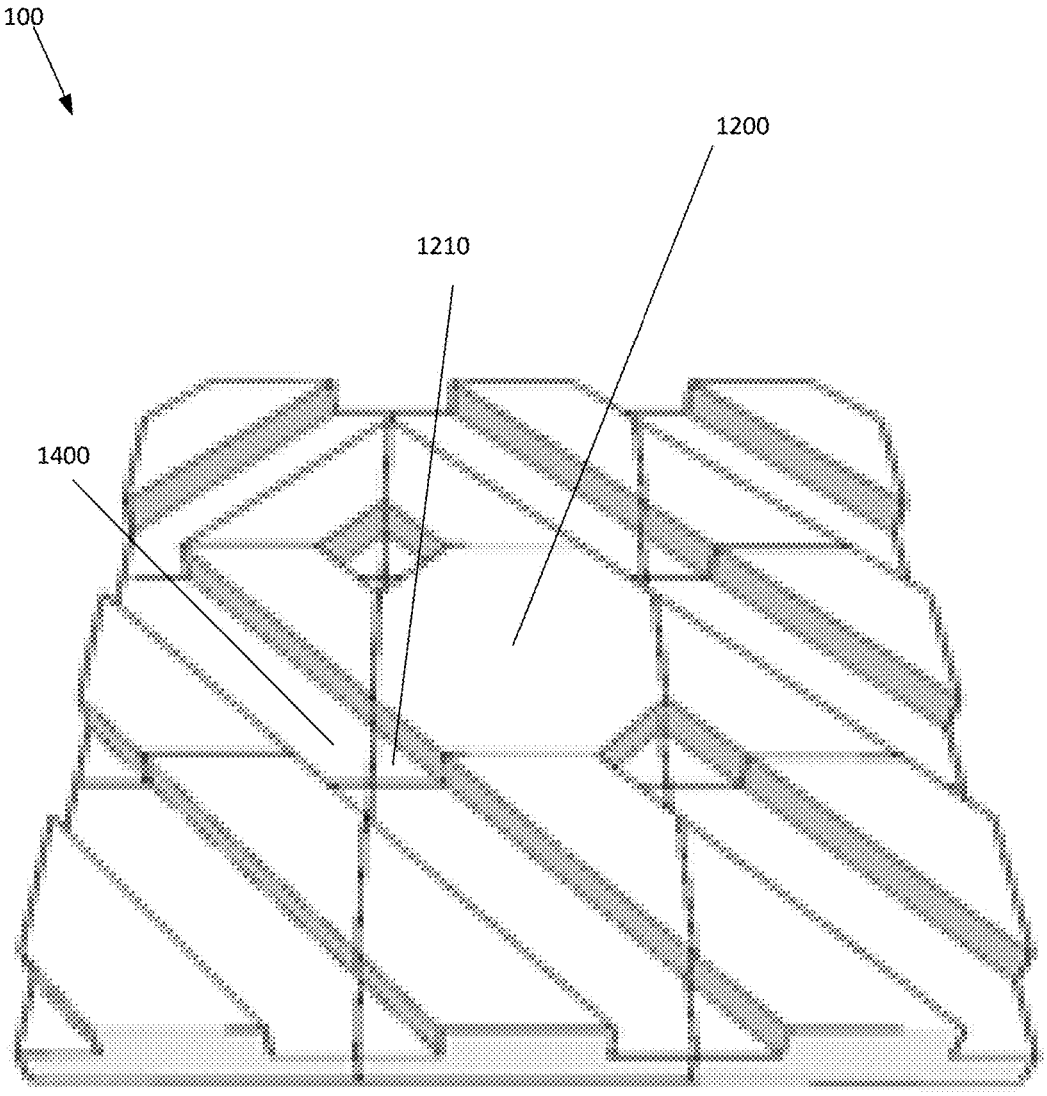
FIG. 14 depicts a perspective view of a system incorporating a block, according to an embodiment.

FIG. 14 depict a perspective view of system 100 incorporating block 1200, according to an embodiment. Elements depicted in FIG. 14 may be described above. For the sake of brevity, a further description of these elements is omitted.

As depicted in FIG. 14, block 1200 may be configured to extend passageway 1400. However, block 1200 may not include any additional channels. As such, block 1200 may be configured to direct passageway 1400 in a specific direction.

Figure 15:
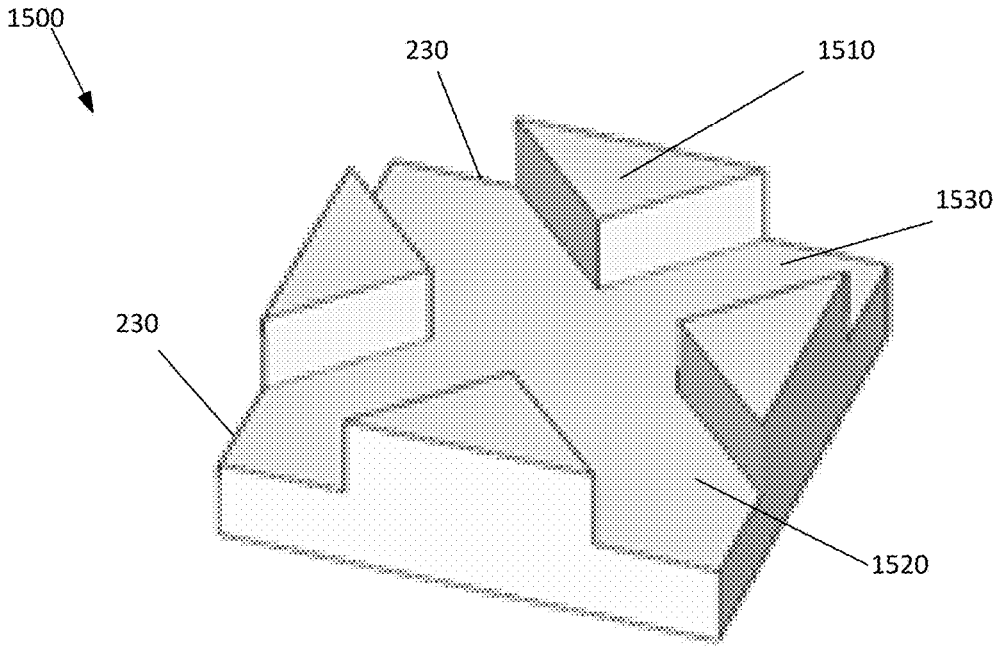
FIGS. 15 and 16 depict a perspective and bottom view of a block, according to an embodiment.
Figure 16:
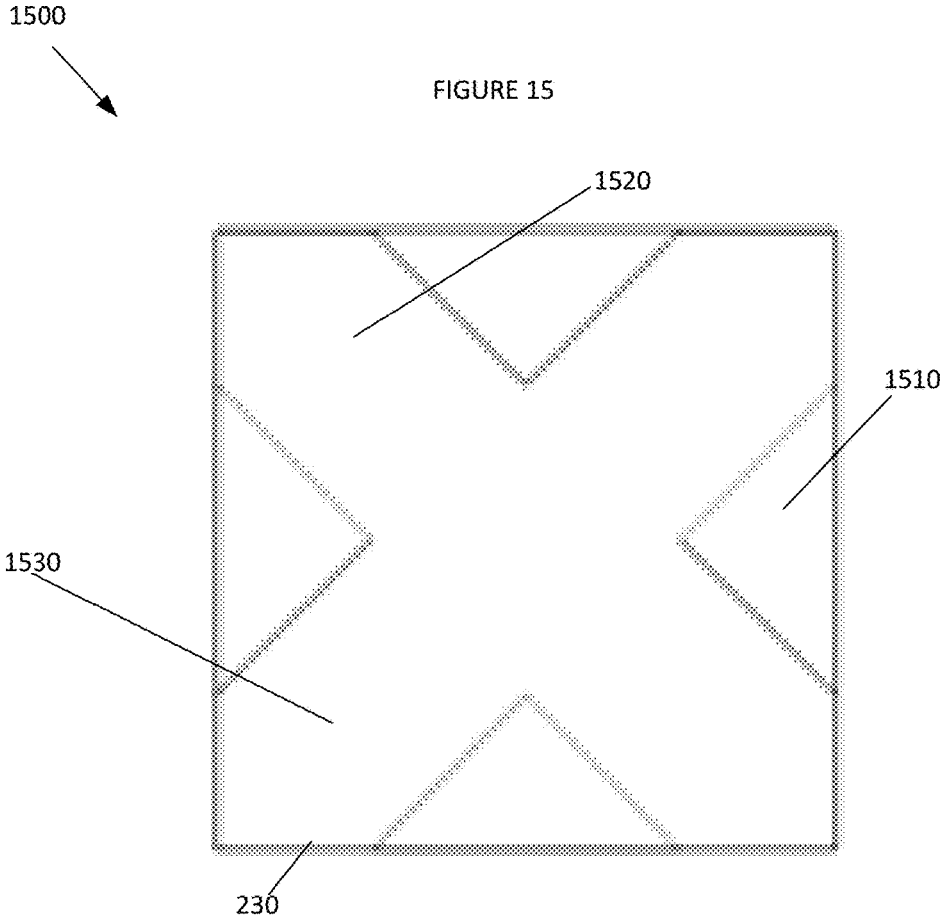

FIGS. 15 and 16 depict a perspective and top view of block 1500, according to an embodiment. Elements depicted in FIGS. 15 and 16 may be described above. For the sake of brevity, a further description of these elements is omitted.

As depicted in FIGS. 15 and 16, block 1500 may include a plurality of projections 1510, each positioned on a different edge of block 1500. Furthermore, block 1500 may include two channels 1520, 1530, that are configured to bisect block 1500, such that block 1500 is symmetrical across each bisection. As such, block 1500 may have the same effect on the passageway no matter which direction block 1500 is oriented with system 100.

In embodiments, channels 1520, 1530 may be configured to divert a pathway of system 100 to have multiple endpoints. This may be utilized to elongate the overall length of the pathway. Additionally, a length 230 between each corner of block 1500 and the sidewalls of the projections 1510 may be the same distance as that of other blocks.

Figure 17:
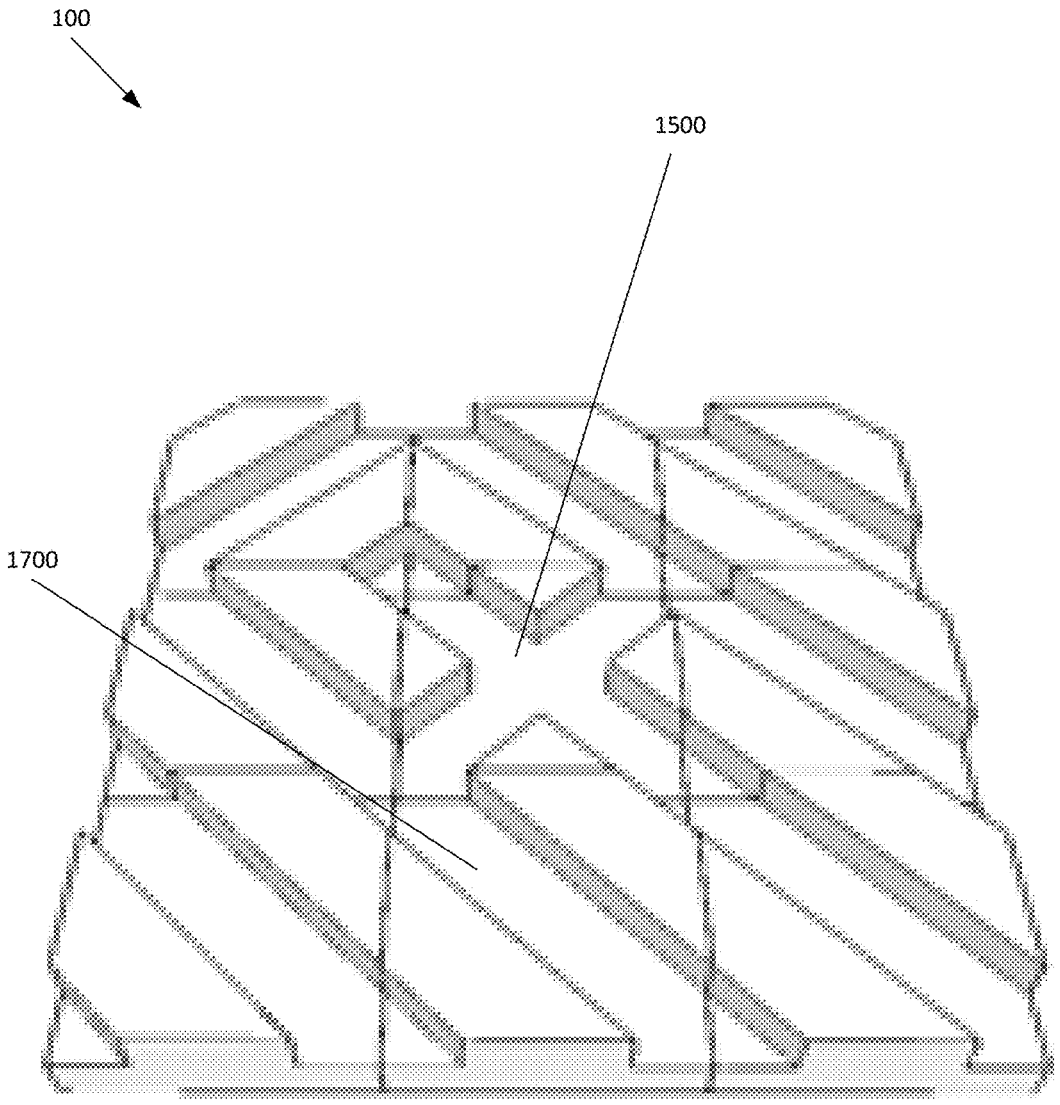
FIG. 17 depicts a perspective view of a system incorporating a block, according to an embodiment.

FIG. 17 depict a perspective view of system 100 incorporating block 1500, according to an embodiment. Elements depicted in FIG. 17 may be described above. For the sake of brevity, a further description of these elements is omitted.

As depicted in FIG. 17, block 1500 may be configured to extend and divert passageway 1700.

Figure 18:
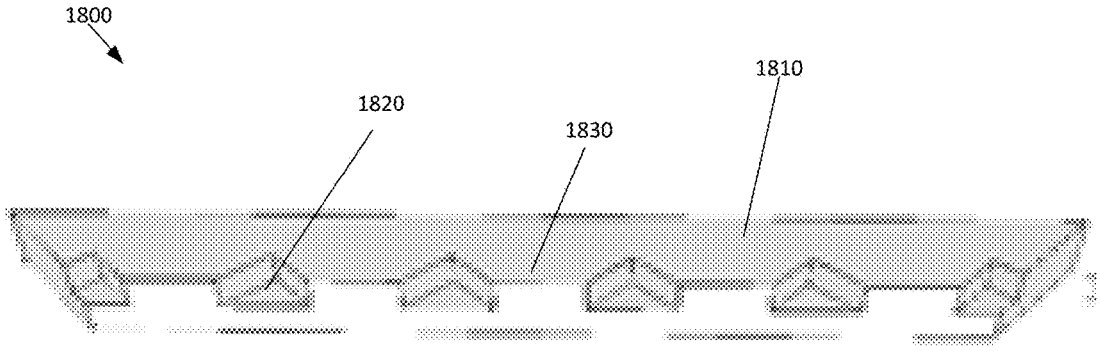
FIGS. 18 and 19 depict a perspective and top view of an outer edge, according to an embodiment.
Figure 19:
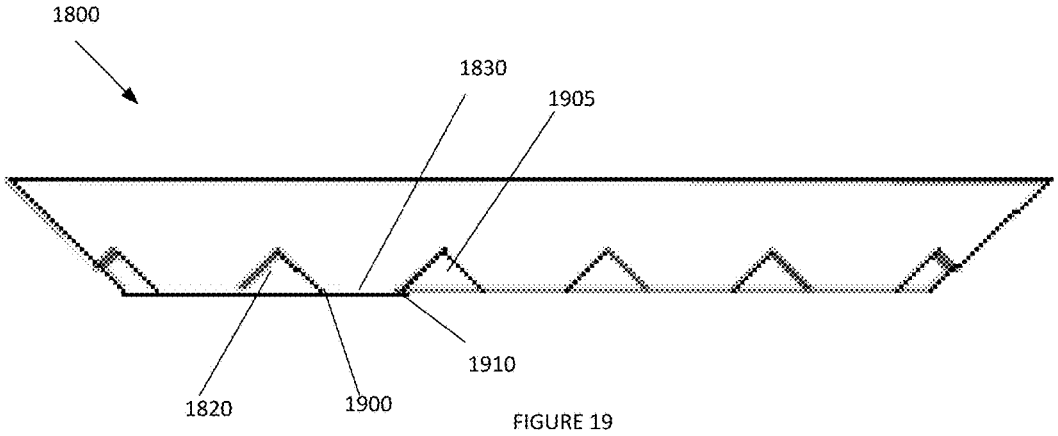

FIGS. 18 and 19 depict a perspective and top view of outer edge 1800, according to an embodiment. Elements depicted in FIGS. 18 and 19 may be described above. For the sake of brevity, a further description of these elements is omitted.

Outer edge 1800 may be configured to be a side 1810 of a perimeter of system 100, wherein grooves 1820 positioned within an inner sidewall of edge 1800 may be configured to interact with the channels on the blocks. Edge 1800 may have any desired length, which may be based on the sizing of system 100. Side 1810 may have a height that is the same as that of the projections within the blocks. Grooves 1820 may have the same height of the grooves within the blocks.

In embodiments, grooves 1820 may be positioned in a repetitive pattern, such that a distance between a first boundary 1900 of a first groove 1820 is based on the length of blocks and the distance between the corner of the blocks and the first sidewall of a projection (element 230 described above). Specifically, distance 1830 between two grooves 1820, 1905 may be the length of a block (which may all be the same length) minus two times the distance between the corner of the blocks and the first sidewall of a projection (element 230). Due to the exact spacing and size of grooves 1820 within edge 1800, edge 1810 may interact with the channels on the blocks to extend the passageway.

Furthermore, each of the edges 1800 may have tapered or angled edges, such that edges 1800 may be positioned adjacent to two other edges to form a rectangular system. In other embodiments, the sizing and/or shape of the edges may be based on the sizing and/or shape of the blocks.

Figure 20:
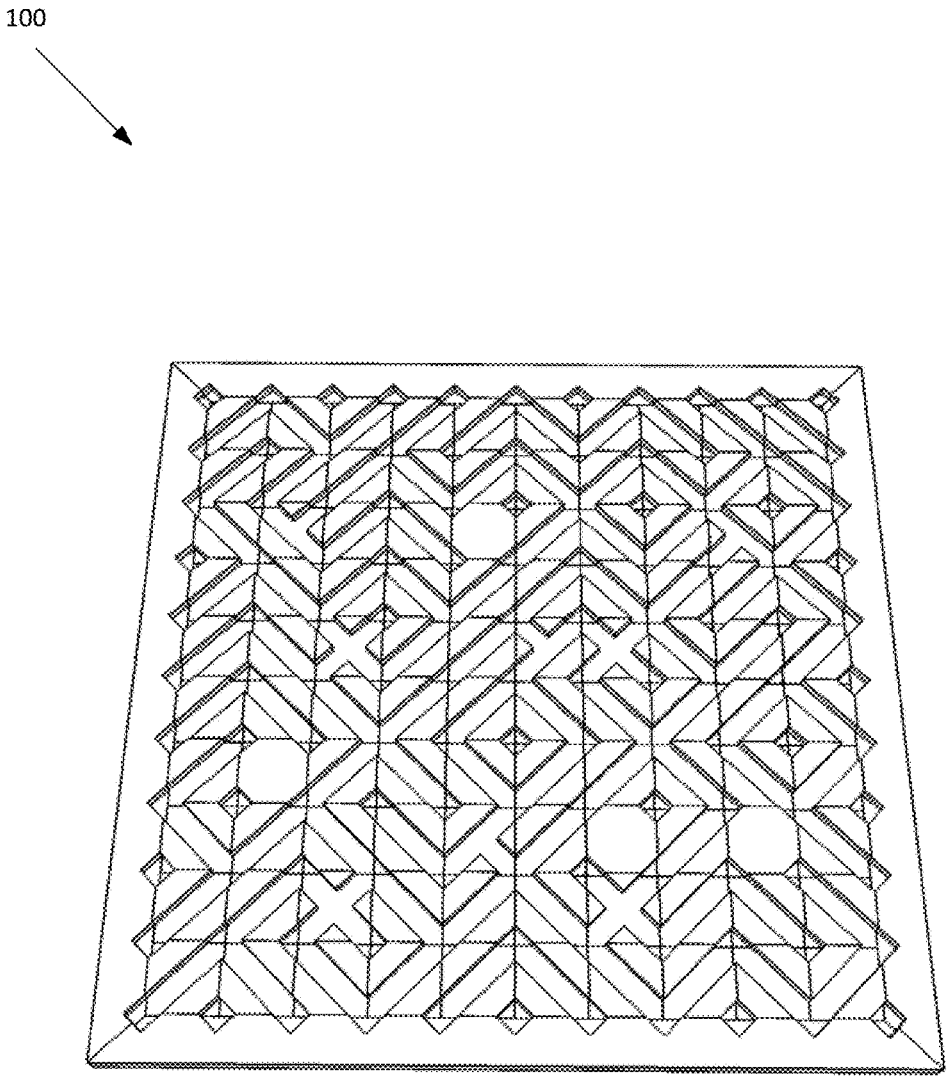
FIG. 20 depicts a perspective view of a system incorporating blocks, according to an embodiment.

FIG. 20 depict a perspective view of system 100 incorporating blocks, according to an embodiment. Elements depicted in FIG. 20 may be described above. For the sake of brevity, a further description of these elements is omitted.

As depicted in FIG. 20, system 100 may include a plurality of different shaped blocks that interact with edges to form pathways through system. The pathways may be formed based on the channels within the individual blocks, wherein the pathway continues from a first channel on a first block, to grooves on adjacent blocks, and to a second channel on a second block. Furthermore, by reorienting any of the blocks within system 100, by rotating an individual and independent blocks, the passageway through system 100 may dynamically change.

Figure 21:
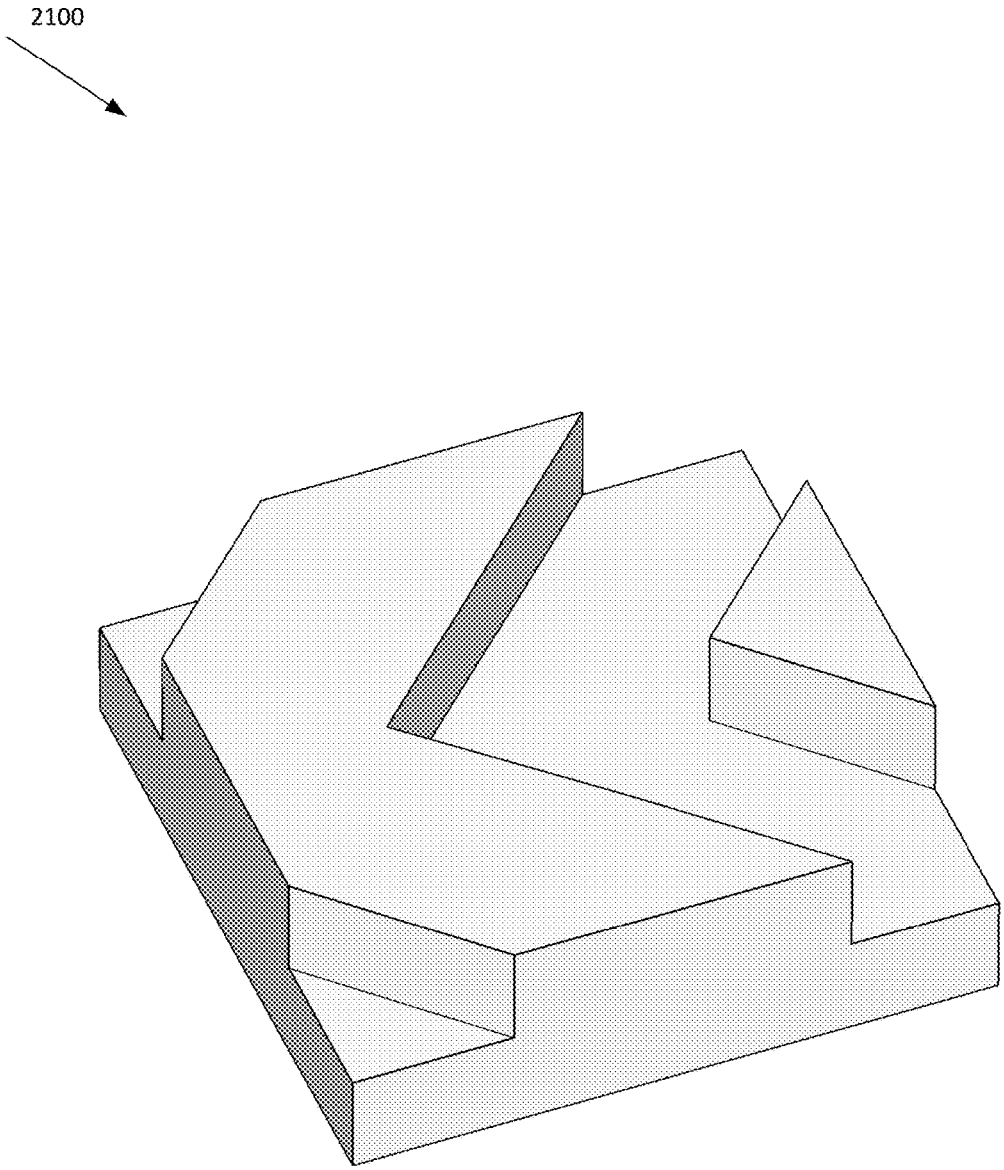
FIG. 21 depicts a perspective view of a block according to an embodiment.

FIG. 21 depicts a perspective view of block 2100, according to an embodiment. Elements depicted in FIG. 21 may be described above. For the sake of brevity, a further description of these elements is omitted.

As depicted in FIG. 21, block 2100 may include a central channel that is shaped like an "L," wherein the channel may elongate a passageway through adjacent edges. Block 2100 may be utilized to angularly direct a passageway through system 100.

Figure 22:
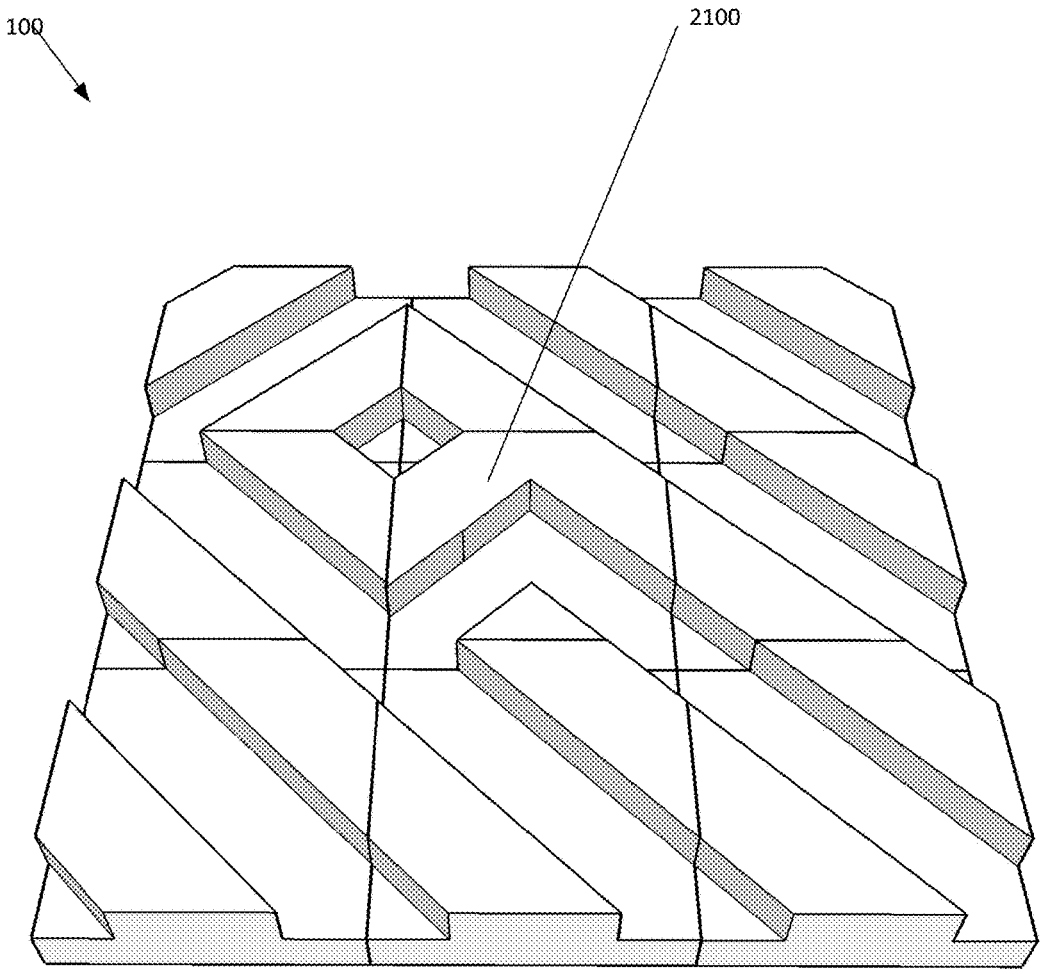
FIG. 22 depicts a perspective view of a system incorporating a block, according to an embodiment.

FIG. 22 depict a perspective view of system 100 incorporating block 2200, according to an embodiment. Elements depicted in FIG. 22 may be described above. For the sake of brevity, a further description of these elements is omitted.

As depicted in FIG. 22, block 2100 may be configured to redirect and/or divert a continuous passageway in a direction that is in parallel to previous parts of the continuous passageway.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A board game system comprising:

a plurality of blocks configured to form a changing passageway based in part in the orientation of the plurality of blocks with respect to each other; the plurality of blocks including;

a base with planar sidewalls and a level bottom surface, projections extending away from an upper surface of the base, the projections extending from a first edge of the base to a second edge of the base;

a channel positioned between the projections, the channel extending from a first corner of the block to a second corner of the block, wherein sidewalls of the projections define the channel, wherein a first projection positioned on the first edge of the base to the second edge of the base of a first block is configured to be positioned adjacent to a second projection positioned on a second block;

grooves positioned at a third corner of the block and a fourth corner of the block, wherein upper surface grooves are positioned at a same vertical offset of an upper surface of the channel.

2. The system of claim 1, wherein a distance from the first corner of the block to a first end of a first sidewall of the first projection is the same distance from the third corner of the block to a second sidewall of the first projection.

3. The board game system of claim 1, wherein the plurality of blocks includes nine blocks with nine independent channels, wherein each of the nine independent channels is part of the passageway.

4. The board game system of claim 3, wherein each of the plurality of blocks is configured to be independently rotated and reinserted into the system.

5. The board game system of claim 4, wherein responsive to rotating the first block of the plurality of blocks, a first channel extending across the first block changes a layout of the passageway.

6. The board game system of claim 1, wherein the plurality of blocks includes the first block, the second block, third block, and a fourth block, the first block being configured to be adjacent to the second block and the third block, the fourth block being configured to be positioned adjacent to the second block and the third block.

7. The board game system of claim 6, wherein a first channel associated with the first block is configured to align with first grooves of the second block and third block and the first channel is configured to align with a second channel associated with the fourth block.

8. The board game system of claim 1, wherein the plurality of projections on different blocks are different shapes and sizes.

9. The board game system of claim 1, wherein the base for each of the plurality of blocks is a square.

10. The system of claim 1, wherein the first block of the plurality of blocks includes two trapezoidal projections, wherein the channel is positioned between the two trapezoidal projections.

11. The system of claim 10, wherein the second block of the plurality of blocks includes three projections, a third projection being a trapezoidal projection, and a fourth projection and a fifth projection being triangular projections.

12. The system of claim 11, wherein a third block includes a single octagonal shaped projection.

13. The system of claim 12, wherein a fourth block of the plurality of blocks includes four triangular shaped projections.

14. The system of claim 1, wherein each of the blocks include grooves that configured to align with the channels of adjacent blocks.

15. The system of claim 14, wherein a length between the grooves is based on a width of the base and a distance from the first corner of the block to a first end of a first sidewall of a first projection, wherein the distance is the same distance from the third corner of the block to a second sidewall of the first projection.

* * * * *